US006101659A

United States Patent [19]

Halm

[11] Patent Number: 6,101,659

[45] Date of Patent: Aug. 15, 2000

[54] TOOTHBRUSH

[75] Inventor: Hans Halm, Herne, Germany

[73] Assignee: SmithKline Beecham GmbH, Germany

[21] Appl. No.: 09/101,379

[22] PCT Filed: Dec. 24, 1996

[86] PCT No.: PCT/EP96/05890

§ 371 Date: Jun. 10, 1999

§ 102(e) Date: Jun. 10, 1999

[87] PCT Pub. No.: WO97/24949

PCT Pub. Date: Jul. 17, 1997

[30] Foreign Application Priority Data

Jan. 10, 1996 [GB] United Kingdom ..... 9600414

[51] Int. Cl.[7] ..... A46B 9/04

[52] U.S. Cl. ..... 15/167.1; 15/172

[58] Field of Search ..... 15/167.1, 172, 15/143.1

[56] References Cited

U.S. PATENT DOCUMENTS 4,763,375 8/1988 Vieten .

5,052,071 10/1991 Halm ..... 15/172

5,054,154 10/1991 Schiffer ..... 15/172

5,630,244 5/1997 Chang ..... 15/167.1

5,673,452 10/1997 Chang ..... 15/172

FOREIGN PATENT DOCUMENTS 0 371 293 6/1990 European Pat. Off. .

0 613 636 9/1994 European Pat. Off. .

*Primary Examiner*—Randall E. Chin

*Attorney, Agent, or Firm*—Nora Stein-Fernandez; Janice E. Williams

[57] ABSTRACT

A toothbrush, in the neck region of which there is an integral thinned part laterally surrounded by a mass of elastomeric material bonded to the plastics material, the mass being of a shape which bulges laterally beyond the line of the surface of the longitudinally adjacent parts of the neck or the head to which it is connected. The thinned part and the bulging mass provide a toothbrush of improved flexibility.

15 Claims, 3 Drawing Sheets

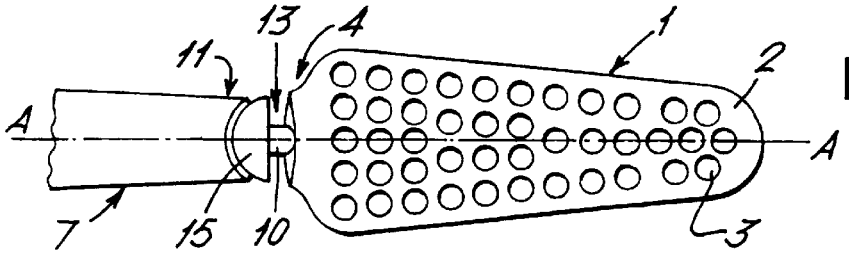
Fig.1.
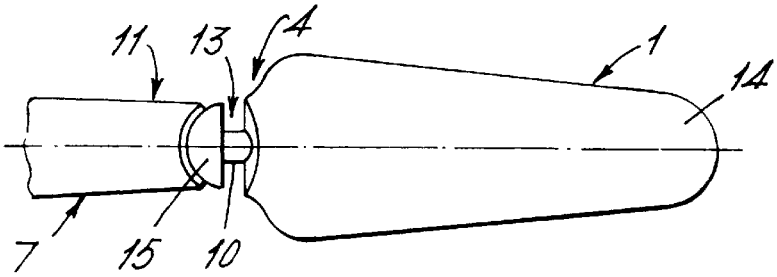
Fig.2.
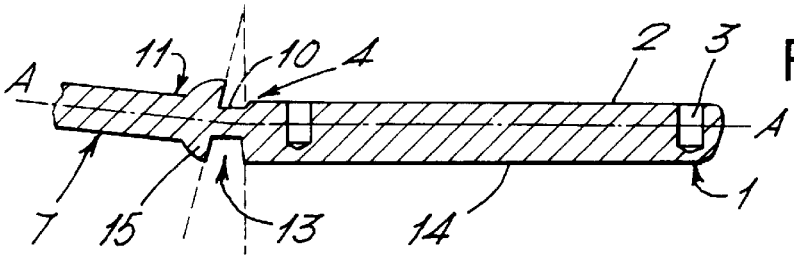
Fig.3.
Fig.4.
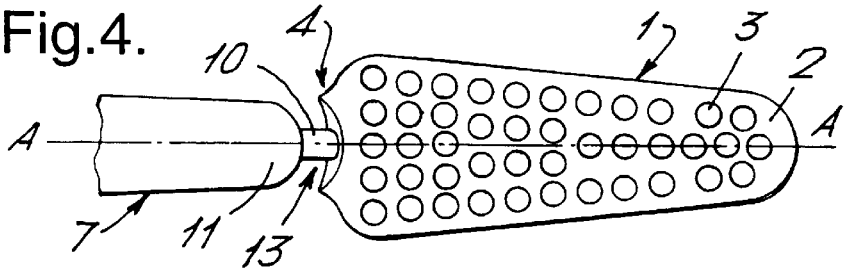
Fig.5.
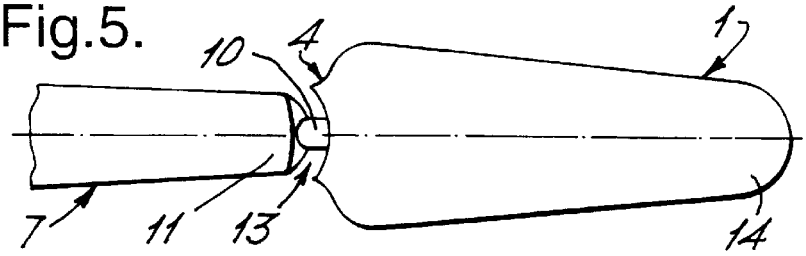
Fig.6.
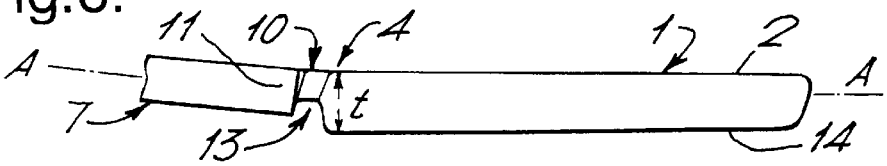

A
8
6
9
5
10
7
4
11
12
1

A
8
6
9
5
7
15
11
12
10
1B
2
1

A
8
6
9
5
7
11
10
4
12
1

A
8
6
9
5
11
12
7
15
10
1B
2
1

TOOTHBRUSH

FIELD OF THE INVENTION

This invention relates to toothbrushes of the type having a flexible link between their head and their handle.

BACKGROUND OF THE INVENTION

Toothbrushes generally consist of a head, from a bristle face of which extend bristles, integrally linked at the base end of the head to the head end of a grip handle, with a neck region between the head and the grip handle, the head, handle and neck being disposed longitudinally.

Toothbrushes are known having a flexible link between the head and the neck region, e.g. in PCT/EP 92/00645. Such toothbrushes are two component toothbrushes comprised of plastics and elastomeric materials, and one such toothbrush is the known Aquafresh Flex 'n Direct™ toothbrush marketed by SmithKline Beecham plc, with a composite plastics material-elastomeric material link between the base end of its head and the immediately adjacent part of its neck. In the Aquafresh Flex 'n Direct™ toothbrush the said link uses a relatively long thin spine to cross a chasm of a complex multiple convex-concave curved shape in the toothbrush. It is an object of the present invention to provide an improved type of flexible link between the head and handle of a toothbrush.

SUMMARY OF THE INVENTION

According to this invention, a toothbrush comprises a head, from a bristle face of which extend bristles, integrally linked at the base end of the head to the head end of a grip handle, with a neck region between the head and the grip handle, all being disposed along a longitudinal axis and made integrally of plastics material, characterised in that in the neck region there is an integral thinned part which is of thinned cross section relative to the longitudinally adjacent parts of the neck and/or the head to which it is connected, the said part being laterally surrounded by a mass of elastomeric material bonded to the plastics material, the mass being of a shape which bulges laterally beyond the line of the surface of the longitudinally adjacent parts of the neck or the head to which it is connected.

The novel construction of the toothbrush provides a link of improved flexibility between the head and the handle compared with known toothbrushes.

DETAILED DESCRIPTION OF THE INVENTION

Preferably the thinned part is located at or immediately longitudinally adjacent to the base of the head, and links the head to the neck. Alternatively the thinned part may be located in the neck and may link longitudinally adjacent parts of the neck, for example lying either closer to the head than to the handle, which is preferred, or closer to the handle than to the head.

Typically the thinned part may be in the form of a thin spine of the plastics material extending longitudinally between facing surfaces of the said longitudinally adjacent parts of the toothbrush. The thinned part may be of any suitable cross section or overall shape to provide a desired degree or type of flexibility in the neck of the toothbrush. The thinned part may have sides which in the direction of the longitudinal axis of the toothbrush are substantially parallel to the said longitudinal axis. For example the thinned part may be of circular cross section and overall cylindrical shape. Alternatively the thinned part may be of oval, rectangular or capsule-shaped cross section with the long axis of such oval, rectangular or capsule-shape aligned in the same direction as the bristles or perpendicular to the bristles.

Typically the part of the head, e.g. the base end of the head, or of the neck to which the head end of the thinned part is connected may be of a concave shape, particularly as viewed in plan (i.e. generally perpendicular to the longitudinal direction and generally parallel to the bristle direction) to the deepest part of which the thinned part connects, or alternatively the part of the head or neck to which the head end of the thinned part is connected may be a surface substantially perpendicular to the longitudinal axis. In such constructions the part of the head or neck to which the handle end of the thinned part is connected may be of a corresponding convex shape, or may have a surface substantially perpendicular to the longitudinal axis. Alternatively if the part of the head or neck to which the head end of the thinned part is connected is of a concave shape then the part of the head or neck to which the handle end of the thinned part is connected may also be a concave shape of opposite curvature, so as to form a rounded cavity bounded in part at its longitudinal ends by these two respective concave surfaces.

In such constructions the thinned part may in effect bridge a widthways aligned chasm across the neck of the toothbrush, or between the head, e.g. at its base end, and the neck of the toothbrush. The chasm may in effect therefore be a parallel sided slot or a curved sided slot, e.g. with both of its head-end side and handle-end side following a part circular curve. For example the thinned part may be connected at its head end to the base end of the head, the part of the base end of the head to which the head end of the thinned part is connected being of a concave shape, to the deepest part of which the thinned part connects, and the part of the head or neck to which the handle end of the thinned part is connected being of a corresponding convex shape, such that the facing surfaces of the head end of the neck and the base end of the head define a curved chasm between them. Both the facing surfaces of such a curve preferably follow a crescentic curve which is substantially part circular over substantially all its length, with the cusps of the crescent pointing generally toward the handle end of the toothbrush.

As viewed from the side (i.e. from a direction perpendicular to the longitudinal axis and the bristle direction), the said facing surfaces may be aligned substantially perpendicular to the longitudinal toothbrush axis, or may be inclined at a non-perpendicular angle to this axis. For example the surfaces of the chasm between the head end of the neck and the base end of the head may be inclined at an angle such that their extrapolation converges on the bristle surface side of the toothbrush.

The thinned part may bridge the chasm symmetrically relative to the longitudinal axis or it may be nearer to one or other of the bristle face or the reverse face of the toothbrush for example to cause the link to be more flexible in one flexing direction than in others or to impart a desired strength to the so-formed link. For example as viewed from the side (i.e. from a direction perpendicular to the longitudinal axis and the bristle direction) the thinned part may be closer to the bristle face than to the reverse face of the head. For example the connection between the thinned part and the base end of the head may be entirely or substantially in the part of the base end of the head and/or neck which is in terms of the thickness of the head and/or neck, in the half nearer to the bristle face of the head and/or neck.

The cross section of the thinned part may for example be 0.1–0.75, suitably 0.25–0.5 of the cross section of the immediately longitudinally adjacent parts of the toothbrush. In a typical toothbrush (toothbrushes are generally all of about the same size), the width of the said chasm (i.e. in the longitudinal direction of the toothbrush) may be ca. 1–5 mm, typically 2–3 mm, at a point where the neck of the toothbrush has a width (i.e. perpendicular to the longitudinal axis and to the bristle direction) of ca. 4–7 mm and a thickness (i.e. perpendicular to the longitudinal axis and parallel to the bristle direction) of 3–5 mm. Suitably therefore the thinned part, e.g the spine, may be of a relatively short stubby shape with length width dimensions in the range 2:1 to 1:2, typically 1.5:1 to 1:1.5. A suitable spine may therefore have a width (i.e. across the longitudinal direction of the toothbrush) of ca. 0.4–5 mm, typically about 1–3 mm, and a length corresponding to the above-mentioned width of the chasm it crosses.

The mass of elastomeric material may suitably be a rounded mass. For example it may have a spherical symmetry, an oblate spherical, ellipsoidal or pear-shaped symmetry etc. Where the above-mentioned chasm is a curved slot the curve of the rounded mass may follow the curve of the chasm. At one or both of the parts of the toothbrush longitudinally adjacent to the mass the plastics material may be enlarged into a mass of a shape, i.e. a curved surface, similar to that, i.e. to the curve, of the mass of elastomeric material, and around which the mass of elastomeric material may be formed. The rounded mass may bulge laterally, in the direction perpendicular to the longitudinal axis of the toothbrush and generally in the bristle direction, to between about 1.5 to 4, e.g. 2 to 3 times the thickness of the immediately adjacent part of the neck and/or the base end of the head. The rounded mass may bulge laterally, in the direction perpendicular to the longitudinal axis of the toothbrush and generally perpendicular to the bristle direction, to between about 1.01 to 1.5, e.g. 1.1 to 1.3 times the width of the immediately adjacent part of the neck and/or the base end of the head. Using the plastics and elastomeric materials of which known two component toothbrushes, e.g. the Aquafresh Flex 'n Direct™ toothbrush, are normally made these dimensions are found to be suitable to provide a link between the neck and the base end of the head with flexibility.

In a preferred embodiment of the invention the thinned part links the head to the neck, and is in the form of a longitudinal spine bridging a curved chasm with the concave side of the chasm adjacent to the head and the convex side of the chasm adjacent to the neck; or a substantially parallel sided transverse chasm across the neck or between the head and the neck, the spine being closer to the bristle face than to the reverse face of the head, and the mass of elastomeric material being of spherical symmetry.

The other parts of the toothbrush may be of essentially conventional construction. Alternatively the neck and handle parts of the toothbrush may for example include flexibility—modifying features such as the "U" shaped folds disclosed in EP 0336641 A, the contents of which are included herein by way of reference. For example the handle may include, as an integral part thereof, a resiliently flexible portion comprised of at least one "V" or "U" shaped fold formed integrally with the remainder of the handle and in a plane from 30° to 150° to that in which the handle lies. A longitudinal structural rib may be provided across such folds. The above-described link between the base head of the head and the neck of the toothbrush, when used in a toothbrush having such a resiliently flexible portion, is found to be particularly advantageous.

The plastics material and elastomeric material used in the construction of the toothbrush may be known conventional plastics and elastomeric materials as disclosed for example in EP 0336641 A, or as used in the construction of the above-mentioned Aquafresh Flex 'n Direct™ toothbrush. The toothbrush of the invention may be made by conventional injection moulding processes in which the plastics material parts are injection moulded first, and the elastomeric material is then moulded around the hot plastics material in such a way that the two bond by fusion together.

The invention will now be described by way of example only with reference to the accompanying drawings which show:

BRIEF DESCRIPTION OF THE DRAWINGS

FIGS. 1, 2 and 3 show respectively a plan, underside and longitudinal section of the head-neck region of one embodiment of a toothbrush of this invention, without the mass of elastomer being in place.

FIGS. 4, 5 and 6 show respectively a plan, underside and side view of the head-neck region of another embodiment of a toothbrush of this invention without the mass of elastomer being in place.

In FIGS. 3 and 6 which show views of the head 1 from the side (i.e. from a direction perpendicular to the longitudinal axis and the bristle direction) the thinned part 10 is closer to the bristle face 2 than to the reverse face 14 of the head 1. The connection between the thinned part 10 and the base end 4 of the head 1 is entirely or substantially in the part of the base end 4 of the head 1 which, in terms of the thickness (t) of the head 1, is in the half nearer to the bristle face 2 of the head.

DETAILED DESCRIPTION OF THE DRAWINGS

Figure 7:
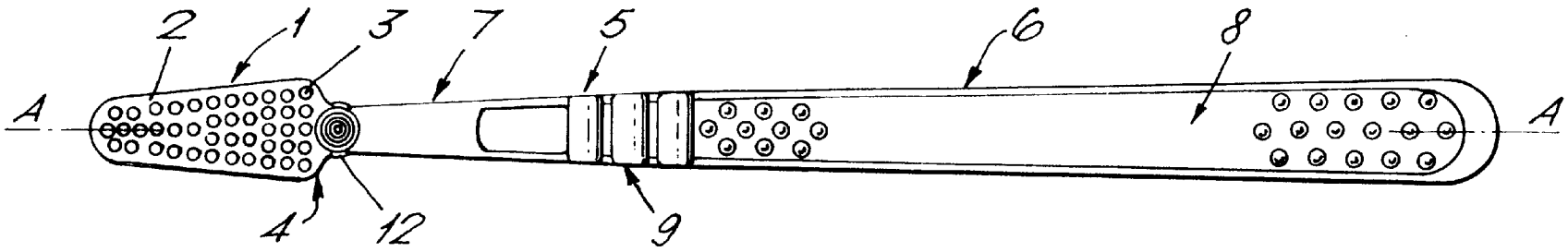
FIGS. 7, 8 and 9 show respectively a plan, underside and side view of the head-neck region of a toothbrush of this invention with the mass of elastomer being in place.

Referring to FIGS. 1, 2, 3, 7, 8 and 9 a toothbrush head 1 is shown, from a bristle face 2 of which extend tufts of bristles (not shown). The bristles are mounted in socket holes 3 (not all shown in FIG. 3) which correspond to the pattern of the bristles. The head 1 is integrally linked at its base end 4 to the head end 5 of a grip handle 6, with a neck region 7 between the head 1 and the grip handle 6, all being disposed along a longitudinal axis A—A and made integrally of plastics material. The grip handle 6 is provided with a grip mat 8 made of elastomeric material, and between the handle 6 and neck 7 is, as an integral part thereof, a resiliently flexible portion 9 comprised of at least one "V" or "U" shaped fold formed integrally with the remainder of the handle and in a plane from 30° to 150° to that in which the handle lies.

Figure 8:
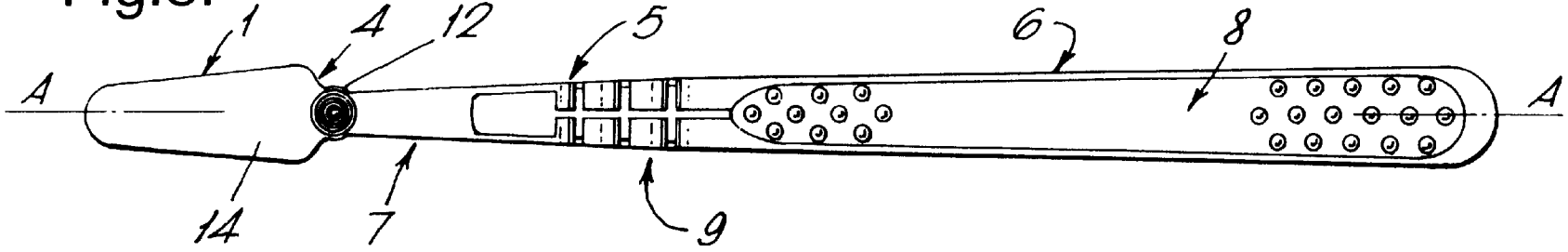
Figure 9:
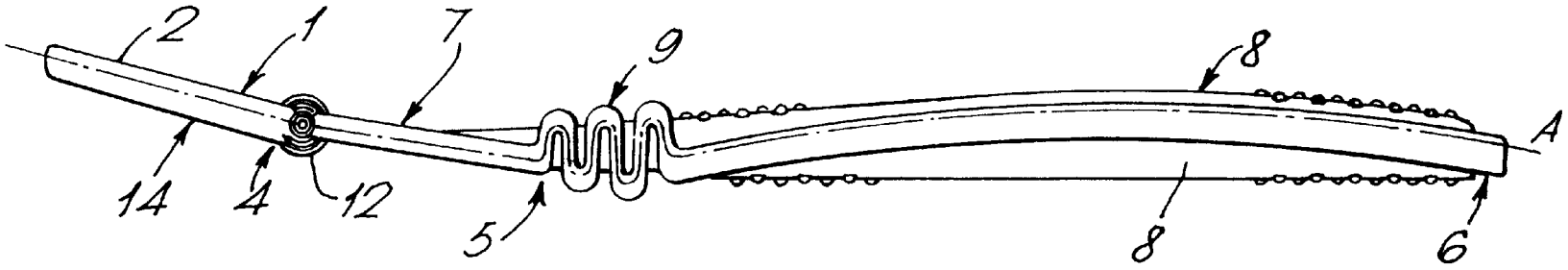

In the neck region 7 there is an integral thinned part 10 connected at one of its ends (the "neck end") to the head end 11 of the neck and at the other of its ends (the "head end") to the base end 4 of the head. The part 10 is of thinned cross section relative to the longitudinally adjacent parts 11, 4 of the neck 7 and the head 1 to which it is connected. The thinned part 10 is of circular cross section about its longitudinal axis direction. As shown in FIGS. 7, 8 and 9 the part 10 is laterally surrounded by a mass 12 of elastomeric material, which is bonded to the plastics material, and is of a shape which bulges laterally beyond the line of the surface of the longitudinally adjacent parts 11, 4 of the neck 7 and the head 1 to which it is connected.

The part 10 is located at the base 4 of the head 1, and links the head 1 to the neck 7. The part 10 is in the form of a thin spine of the plastics material extending longitudinally between the said longitudinally adjacent parts 11, 4 of the toothbrush. The spine 10 is of a relatively short stubby shape with length:width dimensions ca. 1.2:1.

In FIGS. 1, 2 and 3 the part 4 of the head 1 to which the head end of the part 10 is connected has a surface substantially perpendicular to the longitudinal axis A—A, and the part 11 of the neck 7 to which the handle end of the part 10 is connected also has a surface substantially perpendicular to the longitudinal axis A—A.

In FIGS. 4, 5 and 6 the part 4 of the head 1 to which the head end of the part 10 is connected is of a concave shape, to the deepest part of which the thinned part is connected, and the part 11 of the neck 7 to which the handle end of the part 10 is connected is of a corresponding convex shape, forming a curve in which the facing surfaces follow a crescentic curve which is substantially part circular over substantially all its length, with the cusps of the crescent pointing generally toward the handle end of the toothbrush.

In the constructions shown in the Figures the part 10 in effect bridges a chasm 13 between the head 1, at its base 4, and the head end 11 of the neck 7 of the toothbrush. The chasm 13 is in effect therefore a parallel sided slot in FIGS. 1, 2 and 3, and a curved slot in FIGS. 4, 5 and 6. The part 10 bridges the chasm nearer to the bristle face 2 of the toothbrush than to the reverse face 14.

In FIGS. 1 to 6, as viewed from the side (i.e. from a direction perpendicular to the longitudinal axis and the bristle direction), the surfaces of the chasm 13 between the head end 11 of the neck and the base end 4 of the head 1 are inclined at an angle such that their extrapolation converges on the bristle surface 2 side of the toothbrush.

As shown in FIGS. 7, 8 and 9, the mass 12 of elastomeric material is a rounded mass having a spherical symmetry. In FIGS. 1, 2 and 3 the parts 4, 11 of the toothbrush longitudinally adjacent to the mass the plastics material is enlarged into a mass 15 of a hemi-spherical shape similar to that of the mass of elastomeric material 12, and around which the mass 12 of elastomeric material is formed.

FIGS. 1, 2, 3, 4, 5 and 6 show preferred embodiments of the invention in which the part 10 links the head 1 to the neck 7, and is in the form of a longitudinal spine, in FIGS. 4, 5 and 6 bridging a curved chasm 13 with its concave side adjacent to the head, in FIGS. 1, 2 and 3 bridging a substantially parallel sided transverse chasm 13 between the head 1 and the neck 7, the spine 10 being closer to the bristle face 2 than to the reverse face 14 of the head 1, and the mass 12 of elastomeric material is of spherical symmetry.

The plastics material and elastomeric material used in the construction of the toothbrush are known conventional materials as disclosed for example in EP 0336641 A. The toothbrush of the invention has been made by conventional injection moulding processes in which the plastics material parts 1, 6, 7, 10 are injection moulded first, and the elastomeric material is then moulded around the hot plastics material in a known manner such a way that the plastics material and the elastomeric material bond by fusion together to form the elastomeric material grip mat 8 and the mass 12. In the toothbrush shown in the Figures, two injection points may be necessary to inject the elastomeric material to form the grip mat 8 and the mass 12, although they could be connected by a flow channel to allow use of a single injection point.

Referring to FIGS. 10, 11, 12 and 13 toothbrushes are shown of similar construction to those of FIGS. 1–9 above, and corresponding parts are numbered correspondingly.

Figures 10, 11, 12, 13:
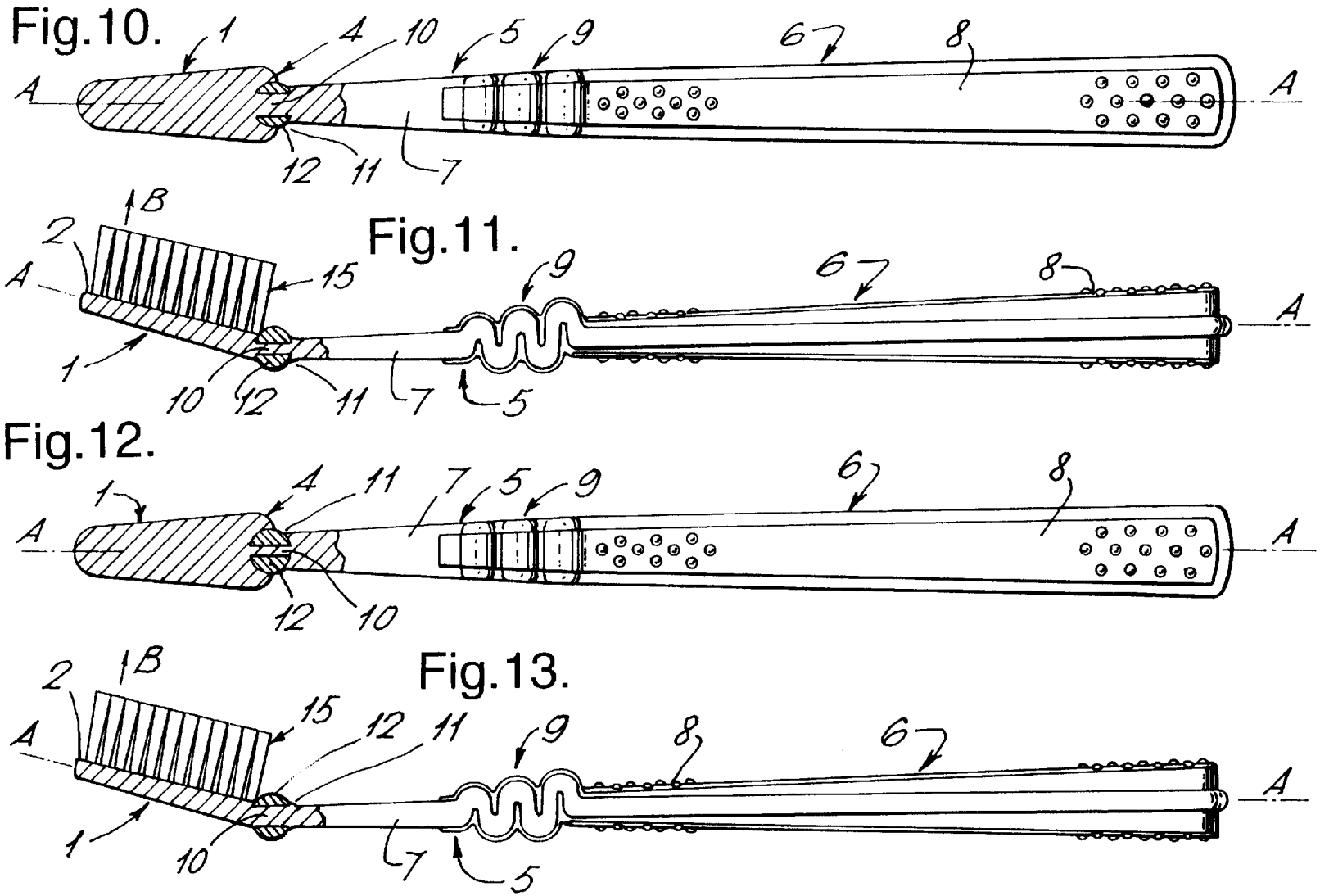
FIGS. 10, 11, 12 and 13 show alternative embodiments of the toothbrush of this invention.

In the toothbrushes of FIGS. 10–13 the part 10 is of a rectangular cross section, with its long axis perpendicular to the direction B of the bristles 15 in FIGS. 10 and 11, and parallel to the bristle direction in FIGS. 12 and 13. In FIGS. 10, 11, 12 and 13 the part 4 of the head 1 to which the head end of the part 10 is connected is of a concave shape, to the deepest part of which the thinned part is connected, and the part 11 of the neck 7 to which the handle end of the part 10 is connected is also of a concave shape of opposite curvature to form a rounded cavity. The mass 12 of elastomeric material is of spherical shape.

What is claimed is:

1. A toothbrush which comprises a head, a grip handle, and a neck region, being integrally made of a plastics material and being disposed along a longitudinal axis with the neck region between the head and the grip handle;

the head having a face and having bristles extending in a bristle direction from the face, the head having a base end which is proximal to the neck region;

between the base end of the head and the neck region there being a thinned part which is made integrally with the head and neck region and which is connected to longitudinally adjacent parts of the base end of the head and the neck region, the thinned part having a cross section across the longitudinal axis direction which is thinned relative to the longitudinally adjacent parts of the head and neck region to which it is connected, the thinned part being laterally surrounded by a mass of elastomeric material bonded to the plastics material, the mass being of a shape which bulges laterally beyond the line of the surface of the longitudinally adjacent parts of the base end of the head and the neck region to which it is connected, the part of the base end of the head to which the thinned part is connected being of a concave shape as viewed in plan looking along the bristle direction toward the face, the thinned part being connected to the deepest part of the concave shape.

2. A toothbrush according to claim 1 wherein the longitudinally adjacent parts of the base end of the head and the neck region to which the thinned part is connected have respective surfaces which face each other in opposite longitudinal directions and the thinned part is in the form of a thin spine of the plastics material extending longitudinally between and joining the surfaces.

3. A toothbrush according to claim 1 or 2 wherein the part of the neck region to which the thinned part is connected is of a convex shape which corresponds, as viewed in plan looking along the bristle direction toward the face, to the concave shape of the part of the base end of the head to which the thinned part is connected.

4. A toothbrush according to claim 1 or 2 wherein the part of the neck region to which the thinned part is connected is of a concave shape, as viewed in plan looking along the bristle direction toward the face, of opposite curvature to the concave shape of the part of the base end of the head to which the thinned part is connected, so as to form a rounded cavity bounded at its longitudinal ends by these two respective concave surfaces.

5. A toothbrush according to claim 1 wherein the respective surfaces which face each other in opposite longitudinal directions define longitudinally between them a chasm in the plastics material of the toothbrush and which extends across the toothbrush in a direction transverse to the longitudinal axis direction, and the thinned part bridges this chasm in a longitudinal axis direction.

6. A toothbrush according to claim 5 wherein the respective surfaces which face each other in opposite longitudinal directions define a curved chasm as viewed in plan looking along the bristle direction toward the face between them.

7. A toothbrush according to claim 5 or 6 wherein the chasm has a concave curved side proximal to the head, and a convex curved side proximal to the handle and the thinned part is in the form of a longitudinal spine bridging the chasm.

8. A toothbrush according to claim 1 wherein as viewed from a direction transverse to the longitudinal axis direction and the bristle direction the respective surfaces which face each other in opposite longitudinal directions, are aligned at a non-perpendicular angle relative to the longitudinal toothbrush axis direction.

9. A toothbrush according to claim 8 wherein the surfaces are each inclined at an angle such that their extrapolation converges on the side of the toothbrush on which the bristles extend.

10. A toothbrush according to claim 1 wherein the head has a reverse face on its opposite surface to the face from which bristles extend, and the thinned part is connected to the longitudinally adjacent parts of the base end of the head and the neck region nearer to one or other of either the bristle face or the reverse face of the toothbrush.

11. A toothbrush according to claim 1 and wherein the cross section of the thinned part is 0.1–0.75 of the cross section of the immediately longitudinally adjacent parts of the toothbrush to which it is connected.

12. A toothbrush according to claim 1 wherein the mass of elastomeric material is a rounded mass.

13. A toothbrush according to claim 12 and wherein the mass of elastomeric material is of spherical symmetry.

14. A toothbrush according to claim 1 wherein the mass bulges laterally, in the direction perpendicular to the longitudinal axis of the toothbrush and generally in the bristle direction, to between about 1.5 to 4 times the thickness of the immediately adjacent part of the base end of the head and the neck region to which it is connected.

15. A toothbrush which comprises a head, a grip handle, and a neck region, being integrally made of a plastics material and being disposed along a longitudinal axis with the neck region between the head and the grip handle;

the head having a face and having bristles extending in a bristle direction from the face, the head having a base end which is proximal and integrally connected to the neck region;

a thinned part which is made integrally with the neck region and which is situated longitudinally between a proximal part of the neck region which is situated in the neck region between the thinned part and the head, and a distal part of the neck region which is situated in the neck region between the thinned part and the grip handle, the thinned part being connected to longitudinally adjacent parts of the proximal part and distal part of the neck region, the thinned part having a cross section across the longitudinal axis direction which is thinned relative to the parts of the proximal part and distal part of the neck region to which it is connected, the part being laterally surrounded by a mass of elastomeric material bonded to the plastics material, the mass being of a shape which bulges laterally beyond the line of the surface of the longitudinally adjacent parts of the proximal part and distal part of the neck region to which it is connected, the part of the proximal part the neck region to which the thinned part is connected being of a concave shape as viewed in plan looking along the bristle direction toward the face, the thinned part being connected to the deepest part of the concave shape.

* * * * *